US005848339A

United States Patent [19]

Costrop et al.

[11] Patent Number: 5,848,339

[45] Date of Patent: Dec. 8, 1998

[54] ELECTROSTATIC COLOR PRINTING APPARATUS WHEREIN THE RECEPTOR SHEET IS TRANSPORTED BY A RECORDING BELT

[75] Inventors: Dirk Costrop, Duffel; Leo Vackier, 's Gravenwezel; Robert Janssens, Creel, all of Belgium

[73] Assignee: Agfa-Gevaert, Mortsel, Belgium

[21] Appl. No.: 909,381

[22] Filed: Aug. 11, 1997

[30] Foreign Application Priority Data

Dec. 16, 1996 [EP] European Pat. Off. ..... 96203561

[51] Int. Cl.[6] ..... G03G 15/01

[52] U.S. Cl. ..... 399/298; 399/162; 399/306

[58] Field of Search ..... 399/306, 300, 399/298, 388, 364, 162, 178, 223, 299

[56] References Cited

U.S. PATENT DOCUMENTS

| | | | |
|---|---|---|---|
| 4,251,154 | 2/1981 | Russel | 399/299 |
| 4,731,631 | 3/1988 | Monkelbaan et al. | 399/306 |
| 4,751,549 | 6/1988 | Koizumi | 399/178 |
| 4,769,672 | 9/1988 | Hoshi et al. | 399/162 X |
| 4,806,972 | 2/1989 | Tomoyori et al. | 399/223 |
| 4,958,187 | 9/1990 | Tsuchiya et al. | 399/306 |

FOREIGN PATENT DOCUMENTS

444813A2 9/1991 European Pat. Off. .

*Primary Examiner*—Arthur T. Grimley
*Assistant Examiner*—Sophia S. Chen
*Attorney, Agent, or Firm*—Baker & Botts, L.L.P.

[57] ABSTRACT

An improved electrostatographic color printing apparatus includes an exposure unit for forming successive electrostatic latent images on the surface of a recording member in the form of an endless belt, a developing station for sequentially developing the electrostatic latent images to form toner images on the belt, and a transfer zone having electrostatic transfer stations for sequentially transferring the toner images from the belt in superposition onto a receptor sheet fed through the transfer stations while in contact with a belt section therein to produce a multicolour duplex image.

15 Claims, 7 Drawing Sheets

ELECTROSTATIC COLOR PRINTING APPARATUS WHEREIN THE RECEPTOR SHEET IS TRANSPORTED BY A RECORDING BELT

BACKGROUND OF THE INVENTION

1. Field of the Invention.

The present invention relates to an electrostatographic colour printing apparatus in which successive, different colour toner images are transferred from a recording member in the form of an endless belt in superimposed registration on a receptor sheet.

2. Description of the Prior Art.

In an electrophotographic black-and-white printing machine, a photoconductive member is charged to a substantially uniform potential to sensitize the surface thereof. The charged portion of the photoconductive member is image-wise exposed. Exposure of the charged photoconductive member selectively dissipates the charge thereon in the irradiated areas. As a result, an electrostatic latent image is recorded on the photoconductive member corresponding to the informational areas contained in the original document being reproduced. After the electrostatic latent image is recorded on the photoconductive member, the latent image is developed by bringing toner into contact therewith. This forms a developed toner image on the photoconductive member which is subsequently transferred to a receptor sheet. The receptor sheet is then heated to permanently affix the toner image thereto in image configuration.

Multicolour electrophotographic printing is substantially identical to black and white printing described hereinbefore. However, rather than forming a single latent image on the photoconductive surface, successive latent part images corresponding to different colours are recorded thereon. Each single colour electrostatic latent image is developed with toner of a colour complementary thereto. This process is repeated a plurality of cycles for differently coloured images and their respective complementarily coloured toner. Each single colour toner image is transferred to the copy sheet in superimposed registration with the prior toner image, thereby creating a multilayered toner image on the copy sheet. Thereafter, the multilayered toner image is permanently fixed to the receptor sheet creating a colour copy or print.

Superimposed registered toner images can be obtained in different ways.

According to one technique, the distinct charge images are developed on the photoconductive member itself, i.e. so-called add-on development, after which the transfer of the complete image to the receptor paper can occur in one step. A disadvantage of this system is that only the very first part image on the photoconductive member can be formed without difficulties. For each subsequent part image, the exposure has to take account of the amount of toner already present on the photoconductive member, the toner has to be sufficiently transparent for the exposing wavelength, and the next magnet brushes shall not damage the former image.

According to another technique the distinct charge images are developed with the appropriate toner while on the photoconductive member, without superimposition. The different toner images are then accumulated in superimposition on an intermediate medium, which usually is a relatively soft material such as rubber in the form of a drum or belt. Transfer from this medium to the receptor paper occurs in one passage. Disadvantages of the system are that each toner image is transferred twice resulting in a reduced image quality, and that the machine becomes more complex.

Still another technique comprises developing the different part images on the photoconductive member without accumulation, and transferring the different developed toner images in superimposition on the receptor sheet. The latter can be attached to a suitable carrier which revolves the sheet four times past the photoconductive member to pick up the corresponding toner image. Disadvantages are the more complex paper path with increased risk for paper jam, the limitation of throughput as a consequence of the repeated passages (usually four) of the paper past the photoconductive member, and the limited assortment of receptor sheets that can be used.

Another serious disadvantage is formed by the presence of the receptor sheet carrier in the electrostatic field of the image transfer station. Each defect in such carrier causes a defect at the corresponding place of the receptor sheet.

A still further system is a copier system comprising developing stations for sequentially developing electrostatic latent images on the surface of a recording member in the form of an endless belt to form toner images on such belt, electrostatic transfer stations for sequentially transferring said toner images from the belt in superimposition onto a receptor sheet conveyed by a backing belt through such transfer stations while in contact with a recording belt section therein to form a multicolour image, and recording belt conveying means for conveying said belt in a folded path between said transfer stations to form an image buffer between adjacent transfer stations. A machine embodying the described system is disclosed in U.S. Pat. No. 4,751,549. While this machine is interesting from the point of simplicity of the path followed by the receptor sheet, so that paper jam is unlikely to occur, one problem is formed by the precision of the drive of the receptor sheet synchronously with the photoconductive belt. Further, this system is hampered by the same defect as the one described hereinbefore, viz. the presence of the carrier for the receptor sheet in the electrostatic field of the transfer stations. Also, the transfer belt runs in contact with the photoconductive surface of the recording belt, and this notably reduces the lifetime and consequently requires timely replacement of the transfer and/or recording belt.

Another apparatus operating with a photoconductive endless belt is disclosed in EP A1 0 258 863. In this apparatus the different colour printing portions comprise erasing, charging, exposure, development and cleaning stations are placed between successive transfer stations.

A disadvantage of this machine is the uncontrolled path of the receptor sheet between successive stransfer stations so that registering of the distinct part images may be unsatisfactory. Another disadvantage of this apparatus is that all electrophotographic sub-systems (as there are: erase, charge, exposure and cleaning) are needed for each colour, resulting in a more expensive system. All this complicates the constructive design of the machine and its servicing.

SUMMARY OF THE INVENTION

Objects of the Invention

It is one object of the present invention to provide an electrophotographic colour printing apparatus of the type referred to, which affords a simple and secure path for the receptor sheet, so that a high registering accuracy and a very small jam rate may be obtained.

It is another object of the invention to provide an apparatus of the type referred to which is suitable for duplex printing.

It is a further object to provide a colour printing apparatus which allows the use of receptor sheets with a broad paper weight range, viz. a range at least extending from 60 to 500 g/sq.m.

It is a still further object of the invention to provide a printing apparatus which causes less front end losses for the receptor sheets.

Statement of the Invention

In accordance with the present invention, an electrostatographic colour printing apparatus which comprises:

exposure means for forming successive electrostatic images on the surface of a recording member in the form of an endless belt, developing stations for sequentially developing such electrostatic latent images to form toner images on said belt, and electrostatic transfer stations for sequentially transferring said toner images from said belt in superposition onto a receptor sheet fed through such transfer stations while in contact with a belt section therein to form a multicolour image, is characterised in that the transport of said receptor sheet through said transfer stations occurs by frictional contact of said sheet with the corresponding belt sections in said stations under the influence of electrostatic attraction forces, in the absence of a moving backing belt, that said transfer stations are mounted thus close to each other and that they comprise directional means imparting a direction of motion to the corresponding operative section of the endless belt which is such that a receptor sheet leaving such transfer station is conveyed into appropriate contact with the corresponding belt section of the next transfer station, and that at least two of said developing stations are mounted between the exposure means and the first transfer station.

In some cases, such as with very light-weight receptor sheets, i.e. sheets with a weight less than 60 $g.m^{-2}$, or sheets tending to curl, it may be desirable to further improve control of the reproducible pick-up of the leading edge of a sheet by the recording belt. This can occur by means of nozzles producing air jets directed to the rear side of a receptor sheet. Further, stationary guide members in the form of fingers, flexible wires or the like can be provided to perform such control.

The term "receptor sheet" as used further in the present specification stands for a sheet of paper, plastic, a laminate of both, and the like onto which the transferred image is received. This sheet may be the end-product as such but it may also form an intermediate step in a reproduction process, e.g. it may be used, after a suitable treatment, as a so-called transfer element, e.g. as a printing plate for printing images by planographic printing techniques onto a final support.

The term "colour" is not strictly limited to the development of usual colour separation images by conventional magenta, cyan, yellow and black toners, but encompasses also the production of images by means of more than three colours, by means of different shades of one colour, e.g. different grey shades, the covering or coating of an image by an image-wise applied transparent, coloured, fluorescent or otherwise treated varnish, and the like.

The term "printing" stands in the first place for a printer which creates the output printing image by laying out the image in a series of horizontal scan lines, each line having a given number of pixels per inch. An exposure station for exposing the recording may comprise a laser with a rotating mirror block, a LED array, a uniform light source and a plurality of individually controllable light valves, an arrangement with deformable micromirror devices, etc. However, said term encompasses also an apparatus in which the exposure of the recording member occurs by the optical projection of an integral image, such as in a copier, see e.g. U.S. Pat. No. 4,751,549 mentioned hereinbefore.

The term "recording member" refers in the first place to an endless belt which is made of, or comprises a layer of an organic or inorganic photoconductor which can be uniformly electrostatically charged and next image-wise discharged by appropriate integral or scanning-wise exposure. However, this term also encompasses an endless belt made of an organic film having no photoconductivity at all, and which is image-wise electrostatically charged by means of an ion radiation array. For that reason the term "electrostatographic" has been used in the statement of invention.

Suitable embodiments of a printing apparatus according to the invention are as follows.

The apparatus comprises belt conveying means for conveying said belt in a folded path between said transfer stations to form an image buffer between adjacent transfer stations. This embodiment has the advantage that one exposure station only may be needed which may expose the distinct part images in succession on the recording belt. Another advantage is that one erase station, one charging station and one cleaning station only are needed for erasing, charging and cleaning the photoconductor for the distinct part images.

The different images are developed in the appropriate colour and transported through the mentioned buffer zones until the moment for (simultaneous) progressive toner image transfer has arrived.

The developing stations can be mounted all between the exposure means and the first transfer station. This allows the mounting of such developing stations in grouped fashion which is interesting from the points of constructive design and servicing of the apparatus. The same advantages count for the transfer stations which now, by the absence of the exposure stations within the loops of the recording belt, are more compact and thus easier to design.

Furthermore, this construction needs only one cleaning and one erasing station so that a compact installation may be obtained.

These considerations are even more important if the printing apparatus according to the invention is a duplex printer of a type which comprises image-forming means at either side of the path of a receptor sheet through the apparatus.

Still further embodiments of a printer according to the invention are as follows.

The mentioned directional means comprises two parallel belt guide rollers imparting a controlled linear path x to the belt section between such two guide rollers in each transfer station.

The diameter of such rollers is smaller than 50 mm, and suitably smaller than 25 mm.

The length x of the linear path is not larger than 120 mm.

The unsupported distance of a sheet between two successive transfer stations is not larger than the distance over which a sheet is in contact with an image transferring belt section in such station. Suitably, such unsupported distance is not larger than 70 mm.

BRIEF DESCRIPTION OF THE DRAWINGS

The invention will be described hereinafter by way of example with reference to the accompanying drawings wherein.

DETAILED DESCRIPTION OF THE INVENTION

Figure 1:
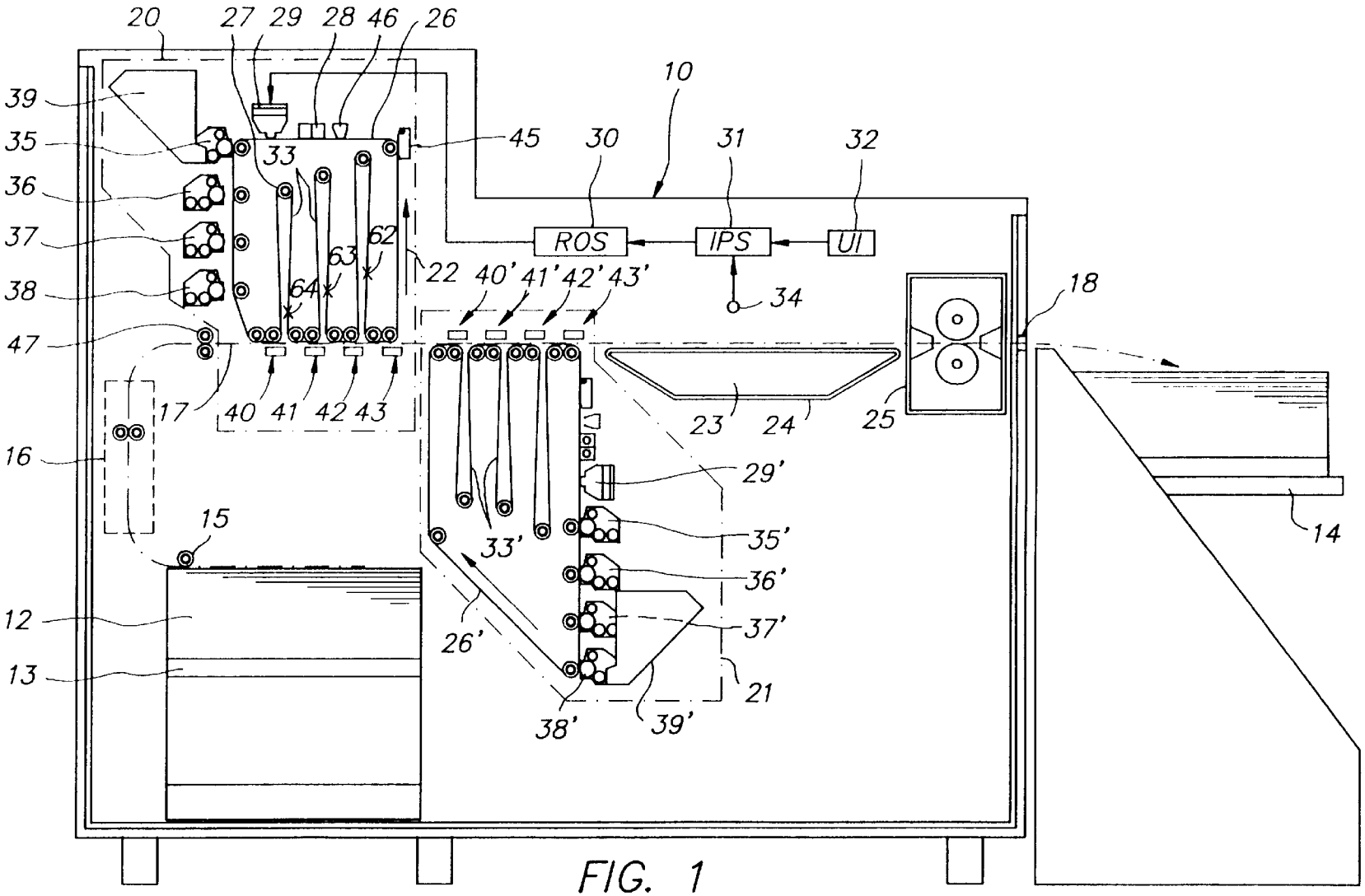
FIG. 1 is a diagrammatic view of an embodiment of a duplex colour printer in accordance with the present invention, operating with one exposure station for each sheet side.

FIG. 1 shows a diagrammatic representation of one embodiment of an electrophotographic duplex colour printer.

The printer comprises a lighttight housing 10 which has at its inside a stack 12 of sheets to be printed loaded on a platform 13 the height of which is adjusted in accordance with the size of the stack, and at the outside a platform 14 onto which the printed sheets are received.

A sheet to be printed is removed from stack 12 by a dispensing mechanism 15 which may be any mechanism known in the art such as a friction roller, a friction pad, a suction cup, or the like for removing the top sheet from stack 12.

The removed sheet is passed through an alignment station 16 which ensures the longitudinal and lateral alignment of the sheet, prior to its start from said station under the control of the imaging system. As the sheet leaves the alignment station, it follows a straight horizontal path 17 up to outlet 18 of the printer. The speed of the sheet, upon entering said path is determined by driven pressure roller pair 47.

The following processing stations are located along path 17. A first image forming station 20 indicated in a dash-and-dot line for applying a colour image to the obverse side of the sheet and a second station 21 for applying a colour image to its reverse side. A buffer station 23 with an endless belt 24 for transporting the sheet to fuser station 25 while allowing the speed of the sheet to change because the speed of fusing may be different from that of the speed of image formation.

Both image forming stations 20 and 21 being similar to each other, only station 20 will be described in more detail hereinafter.

An endless photoconductor belt 26 is guided over a plurality of idler rollers 27 to follow a path in the direction of arrow 22 to advance successive portions of the photoconductive surface sequentially through the various processing stations disposed about the path of movement thereof. The belt suitably can be a polyethylene terephthalate support which is provided at the outside of its loop with a subbing layer onto which a photoconductive layer has been coated. Means is provided (not shown) for driving the belt at a uniform speed and for controlling its lateral position.

Initially, a portion of photoconductive belt 26 passes through charging station 28. At the charging station, a corona generating device electrostatically charges the belt to a relatively high, substantially uniform potential. Next, the belt is rotated to the exposure station 29, which will expose the photoconductive belt to successively record four latent colour separation images. The exposure station includes a ROS (raster output scanner) 30 with a laser with a rotating polygon mirror block which creates the output printing image by laying out the image in a series of horizontal scan lines, each line having a given number of pixels per inch. However, this station can as well comprise a linear LED array covering the width of the belt for performing the exposure.

The latent images are developed with magenta, cyan, yellow and black developer material, respectively. These developed images are transferred on the print sheet in superimposed registration with one another to form a multicolour image on the sheet. The ROS receives its input signal from IPS (image processing system) 31. This system is the electronic control device which prepares and manages the data inflow to scanner 30. A user interface UI, indicated by reference numeral 32, is in communication with the IPS and enables the operator to control the various operator adjustable functions. IPS 31 receives its signal from input 34. This input can be the output of a RIS (raster input scanner) in case the apparatus is a so-called intelligent or digital copier. In such case, the apparatus contains document illumination lamps, optics, a mechanical scanning drive, and a charge-coupled device. The RIS captures the entire original document and converts it to a series of raster scan lines and measures a set of primary colour densities, i.e. red, green and blue densities at each point of the original document. However, input 34 can as well receive an image signal resulting from an operator operating an image processing station.

After an electrostatic latent image has been recorded on photoconductive belt 26, belt 26 advances this image to the development station. This station includes four individual developer units 35, 36, 37 and 38.

The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 35, 36 and 37, respectively, apply toner particles of a specific colour which corresponds to the compliment of the specific colour-separated electrostatic latent image recorded on the photoconductive surface. The colour of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 10, while the green areas will be reduced to a voltage level ineffective for development. The charged areas are then made visible by having developer unit 35 apply green absorbing (magenta) toner particles onto the electrostatic latent image recorded on photoconductive belt 26. Similarly, a blue separation is developed by developer unit 36 with blue absorbing (yellow) toner particles, while the red separation is developed by developer unit 37 with red absorbing (cyan) toner particles. Developer unit 38 contains black toner particles and may be used to develop the electrostatic latent image formed from black information or text, or to supplement the colour developments. Each of the developer units is brought into and out of an operative state. In the operative state, the magnetic brush is closely adjacent to the photoconductive belt, whereas in the non-operative one, the magnetic brush is spaced therefrom. During development of each electrostatic latent image only one developer unit is in the operative state, the remaining developer units being in their non-operative one. This ensures that each electrostatic latent image is developed with toner particles of the appropriate colour without inter-mingling. In FIG. 1, developer unit 35 has been shown in its operative state. This may be obtained by translation of the complete developer unit, but it is also possible to keep the unit as such stationary but to only slightly alter the position of the magnetic brush. Finally, each unit comprises a toner hopper, such as hopper 39 shown for unit 35, for supplying fresh toner to the developer which becomes progressively depleted by the development of the electrostatic charge images. The hopper may be directly fitted onto the developer unit but may also be connected therewith through a suitable tube.

After their development, the toner images are moved to toner image transfer stations 40, 41, 42 and 43 where they are transferred on a sheet of support material, such as plain paper or a transparent film. At a transfer station, a receptor sheet follows a rectilinear path 17 into contact with photoconductive belt 26. The sheet is advanced in perfect synchronism with the movement of the belt. Advance of the sheet and transfer of a toner image from the belt to the sheet will be described in more detail with reference to FIG. 2 hereinafter. After transfer of the four toner images, the belt follows an upward course and is cleaned in a cleaning station 45 where a rotatable fibrous brush or the like is maintained in contact with the belt 26 to remove residual toner particles remaining after the transfer operation. Thereafter, lamp 46 illuminates the belt to remove any residual charge remaining thereon prior to the start of the next cycle.

The photoconductive belt 26', the belt loop 33', the exposure station 29', the transfer stations 40', 41', 42', and 43', the developer units 35', 36', 37' and 38' and the hopper 39' of image forming station 21 are similar to those of station 20.

Figure 2:
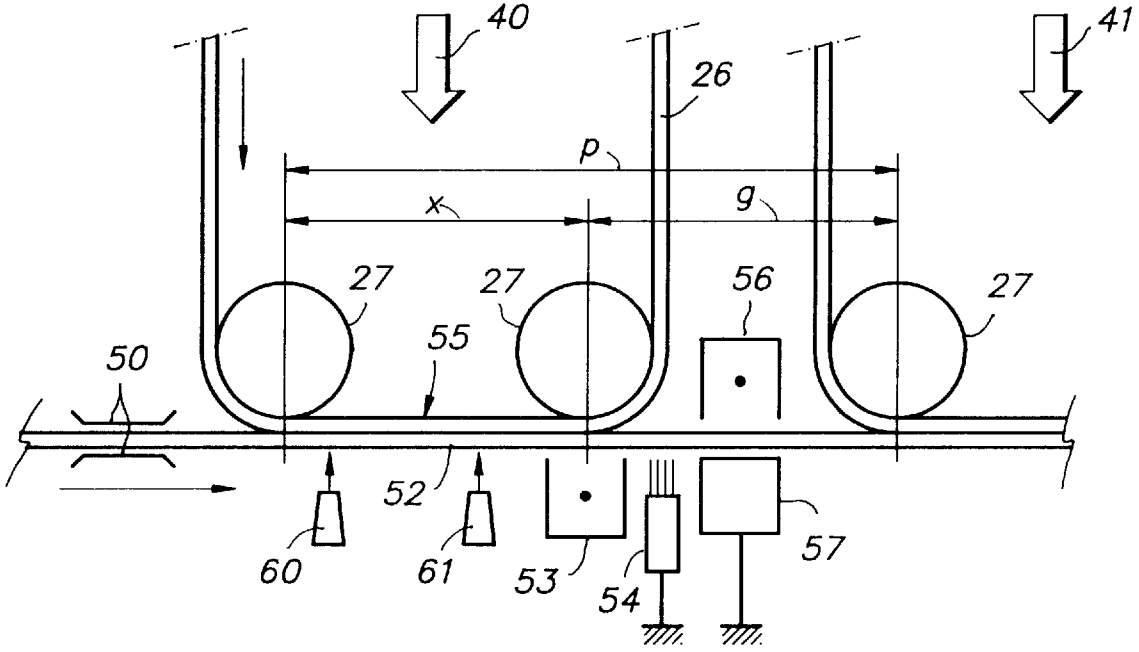
FIG. 2 is a detail of FIG. 1 showing one embodiment of a toner image transfer station.

Referring to FIG. 2, toner image transfer station 40 of FIG. 1 is shown on an enlarged scale.

Transfer station 40 comprises idler rollers 27 for causing photoconductive belt 26 to follow a short horizontal path 55 as shown. The diameter of rollers 27 amounted to 24 mm in the present example, so that the radius of curvature of the upwardly deflected belt 26 at the right-hand roller amounted to only 12 mm. Sheet 52 is in contact with the belt and moves synchronously therewith because the peripheral speed of sheet driving rollers 47 corresponds exactly with the linear speed of photoconductive belt 26. This synchronous movement may be obtained by different systems known in the art and needs therefore no further explanation. It is also possible to drive the sheet by rollers 47 until the sheet is firmly electrostatically engaged by the belt, and next opening the rollers. The sheet is kept in firm contact with the belt as a consequence of electrostatic attraction forces resulting from the belt carrying an electrostatic charge image and from the charging of the sheet by transfer corona 53. Reproducible pick-up of the leading edge of the sheet may be improved if desired by means such as air jets produced by nozzles 60 and 61 biasing the sheet in a direction towards the belt, by stationary guide members such as rigid fingers 50, flexible guide wires, or the like. Such additional expedients may not be required for relatively stiff receptor sheets, e.g. paper sheets having a weight larger than 100 g/sq.m, but may be required for light-weight sheets which may tend to deflect too much from the belt on their travel from one to the next transfer station. Further, it is clear that the corona station 53 may occasionally be preceded by one or more similar coronas to extend the range of electrostatic attraction, and to improve sheet pick-up.

A first, transfer corona generator 53 is located at a position ahead of the point of separation of the sheet from the belt and sprays ions on the rear side of the sheet so as to charge the sheet to a polarity opposite to that of the charge on the toner image on the photoconductive belt. Thus, the sheet is charged to the proper magnitude and polarity for attracting and transferring the toner image from the photoconductive belt 26 thereto. Suitable DC voltages for this generator are between 3000 and 9000 volts.

A brush-like electrode 54 may serve for discharging the sheet after the toner transfer. This electrode can comprise a great plurality of individual, conductive fibres with a diameter down to 10 micrometer that are electrically grounded and thereby are capable of establishing an electric current path with the sheet, even if they remain separated therefrom over a distance up to 2 mm approximately.

After the toner image has been transferred to the sheet and the sheet became separated from photoconductive belt 26 a second, conditioning corona generator 56 can spray ions on the front side of the sheet so as to apply a charge on the toner image on the sheet of a polarity equal to that of the charge on the transferred toner image. In this way, the charge on this side of the sheet is increased. Corona generator 56 may be in principle any type of corona device suitable for carrying out the desired charging, but we have found that excellent results were obtained with an AC corona operating at a peak-to-peak voltage of 8 to 20 kV at a frequency of 50 to 10000 Hz, an offset to the AC high voltage wave being applied ranging between 0 and 2000 DC volts.

The proper operation of corona 56 requires the opposite side of the sheet to be grounded. This has been shown in the figure as occurring by means of block 57. This block 57 can be a conventional AC or DC, or a combination of AC and DC corona, a grounded plate running parallel to the sheet, an electrically conductive brush such as brush 54, a roller or the like. More details about this and the other transfer stations can be found in our co-pending application EP No. 96 20 2251.3 entitled: "Device for electrostatically transferring toner images".

Horizontal section 55 of photoconductive belt 26 imparts a direction of movement to sheet 52 which is such that the sheet is properly directed towards the next transfer station 41, while unsupportedly bridging the gap between both stations in an almost linear way. The gap g between two successive transfer stations in the present example amounted to 43 mm, i.e. the distance centre-to-centre between the second roller 27 of one station and the first one of the next station, whereas the pitch p which is the centre-to-centre distance between the first roller of the successive transfer stations amounted to 75.791 mm. The supported sheet length x amounted to 32.791 mm, the roller diameter being 24 mm as mentioned already.

It is important to keep the gap g small for secure receptor sheet transport and corresponding accurate image registering.

It has been shown that it is possible to transfer four or even more colour part images in superimposition on the receptor sheet with a register error smaller than 75 micrometer as we have found.

Figure 3:
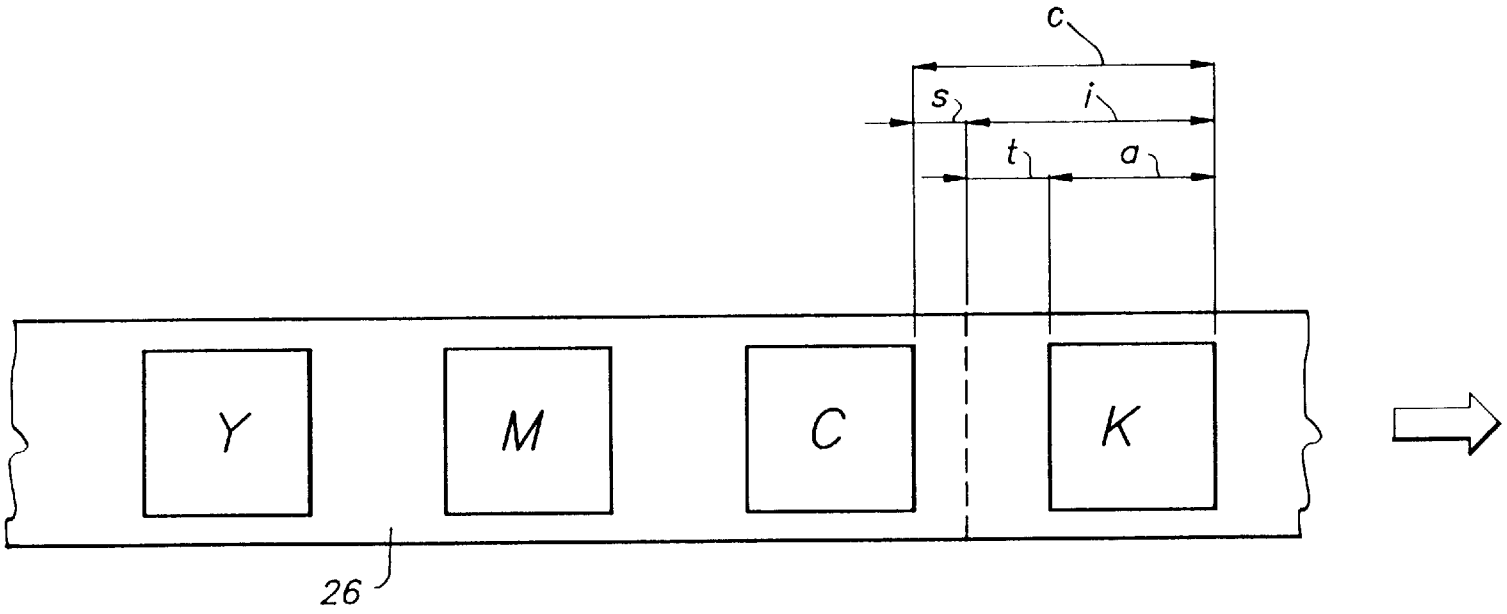
FIG. 3 is a schematic view showing colour part images formed on a photoconductive recording belt.
Figure 4:
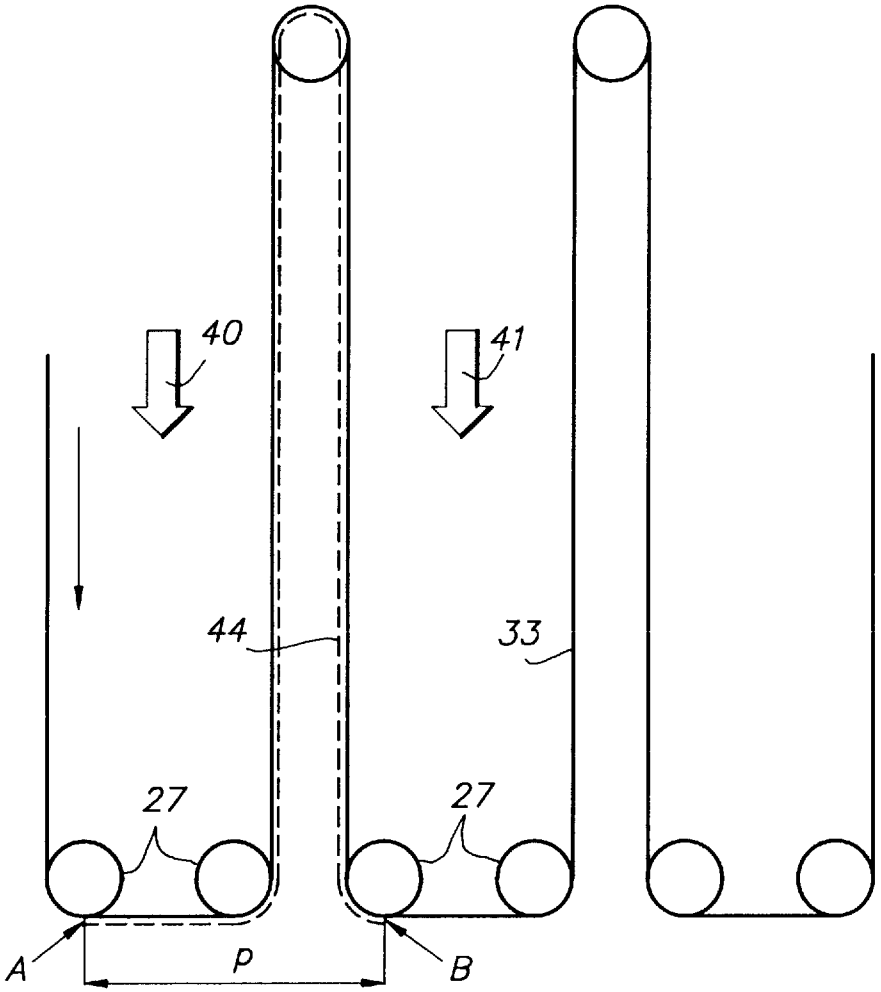
FIG. 4 is a schematic view of an image buffer.

FIG. 3 shows a detail of the position of the distinct colour part images on photoconductive belt 26 whereas FIG. 4 shows the length of an image buffer path between two successive transfer stations. Referring to FIG. 3, belt 26 is shown carrying four colour part images, viz. K, C, M and Y as they have been exposed in succession on the charged belt by exposure station 29. The length of an image plane is indicated by i, being the sum of length a of the proper image and of t being the space provided for test patches, registermarks, cutting lines, and the like. The length of a colour plane is indicated by c, and is the sum of i and of distance s required for allowing the switching of the colour development stations, the transfer coronas, etc.

FIG. 4 shows in detail the belt loop 33 forming an image buffer between two successive transfer stations. The length b of an image buffer (see dashed line 44) between points A and B. which both are the first contact points (in fact a transverse line) of a receptor sheet with successive sections of the belt in the transfer stations, is such that it equals the sum of the length c of a colour plane and of the pitch p which is the linear distance between point A and B (which is identical to the centre-to-centre distance of the corresponding rollers 27 described hereinbefore). Thus: b=c+p.

Further important points of the image transfer are as follows. The length of photoconductive belt 26 preferably is m times the length c of a colour plane, m being an integer. This is because regions of the belt where images are to be formed must be kept out of the seam of the belt, unless the throughput of the apparatus is seriously reduced.

All rollers in the image transfer zones must be wobble-free in order not to generate transfer defects. An alternative is to ensure that the locations of roller-dependent defects are the same in each part image, so that such defects are transferred in coinciding superimposed relationship whereby they are much less visible in the final colour image.

The desired coincidence of roller dependent defects can be obtained as follows.

The theoretic circumference o of each roller shall be n times smaller than the length c of a colour plane, n being an integer. The term "theoretic circumference of each roller" as used in the present description means the diameter measured on the neutral fibre of the photoconductive belt surrounding the roller, or in other words: $o=2\pi\ (r+0.5\ d)$, r being the radius of the roller and d the thickness of the belt.

Further, the theoretic circumference o of a roller in the transfer stations can best be z times smaller than the pitch p between two transfer stations, z being an integer.

Finally, the transmission ratio in the drive system of the printer must be such that for each colour plane the driving components are in exactly the same angular position. Thereby defects in gear wheels, in the case of gear or timing belt drives, or in pulleys, in the case of flat belt drives, will be reproduced in superimposed relationship in the different part images.

It will also be clear that, independently of the above, the motor means driving the belt must be capable of producing a precise, vibration-free drive of the belt.

The operation of the printer described hereinbefore is as follows.

The green latent image being exposed by station 29 on photoconductive belt 26, this image is progressively developed by magenta toner station 35 being in its operative state as the belt moves therethrough. Upon completion of the end of the exposure of the green image and of occasionally a colour wedge, register marks and the like, the blue image becomes exposed. During the blue exposure, the developed magenta image is transported past inactive stations 36, 37 and 38 while toner transfer stations 40 to 43 still are inoperative too.

As the development of the green latent image is finished, magenta development station 35 is switched to its inoperative state and after the trailing edge of the magenta image has passed yellow development station 36, this station is put in the operative state to start the development of the blue latent image. While the latter portion of the yellow latent image is being developed, the exposure of the red latent image at 29 starts already.

The described processes of imagewise exposure and colour development continue until the four colour separation images have been formed in successive spaced relationship on the photoconductive belt.

A sheet 52 which has been taken from stack 12 and kept in readiness in aligner 16, is then advanced by rollers 47. The electrostatic transfer devices of the transfer stations are energized, and as sheet 52 reaches toner transfer station 40 where at that moment the lastly formed toner image, viz. the black-and-white one, is ready to enter the station, toner image transfer can start. Thus, the lastly formed toner image is the first to become transferred to sheet 52. The firstly formed toner image, viz. the magenta one, takes with its leading edge a position on the belt as indicated by the cross 62 and will thus be transferred last. The other two toner images take positions with their leading edges as indicated approximately by crosses 63 and 64, respectively.

The timing of exposure of the four distinct images, the relative position of these images on the photoconductive belt and the lengths of the path of this belt between the successive transfer stations are such that as paper sheet 52 follows a linear path through these stations, the progressive simultaneous transfer of the distinct toner images to the paper sheet is such that a perfect registering of these images is obtained. It will be understood that, as known in the art, measuring of the position of register marks may be useful for controlling via feedback loops the exposure system in order to occasionally correct or improve the positioning of the images on the belt.

Sheet 52 bearing a colour toner image on its obverse side produced as described hereinbefore, is now passed through image forming station 21 for applying a colour toner image to the reverse side of the sheet. The production of the reverse side part images started in timed relationship to the obverse side ones, so that the positions of the images on both sheet sides correspond with each other. The cross-over of the sheet from image forming station 20 to station 21 does not raise any problem since basically this transfer is the same as the transfer of the sheet from one to a next image transfer station.

In the cross-over, a charge conditioning corona can be placed to make sure toner is not jumping on the transfer corona's of station 21.

The sheet electrostatically bearing the colour images is then received on endless belt 24 of buffer station 23 before entering fuser station 25.

The purpose of buffer 23 is as follows. Fuser station 25 operating to melt the toner images transferred to the sheets in order to affix them, it will be understood that this operation requires a certain minimum time since the temperature of the fuser is subject to an upper limit which must not be exceeded, unless the roller lifetime becomes unsatisfactory. In other words, the speed of fuser station 25 is limited. The speed of the image formation stations 20 and 21, on the other hand, is in principle not limited for any particular reason. On the contrary, it is advantageous to use a high speed of image formation and image transfer, since the four colour separations of each colour image are written by exposure station 29 in succession, which means that the recording time of one colour image amounts to at least four times the recording time of one part image. All this means a relatively high speed of the photoconductive belts, and thus of the synchronously moving sheets, as compared with a maximum usable travelling speed through the fuser station. In the apparatus according to the present embodiment, the speed of the two photoconductive belts amounted to 295 $mm.s^{-1}$, whereas the fusing speed was 100 $mm.s^{-1}$ or less.

Further, it may be desirable to adjust the fusing speed independently from the image processing speed, i.e. the belt speed, for optaining optimum results. It should be noted that the image processing speed in the imaging stations is constant.

The length of buffer station 23 is sufficient for receiving the largest sheet size to be processed in the apparatus.

Buffer station 23 operating initially at the speed of the photoconductive belts of devices 20 and 21, the speed of this station is reduced to the processing speed of fuser station 25 as the trailing edge of the sheet has left device 21.

Fusing station 25 can be of known construction, and can be arranged for radiation or flash fusing, for fusing by convection and/or by pressure, etc. The fused sheet is finally received on platform 14.

A printing apparatus according to the present invention is not limited to the embodiment described hereinbefore.

One image forming station, such as 20, need not necessarily operate with one exposure station, such as 29, but may include more than one exposure station, each such station co-operating with several developer units.

Figure 5:
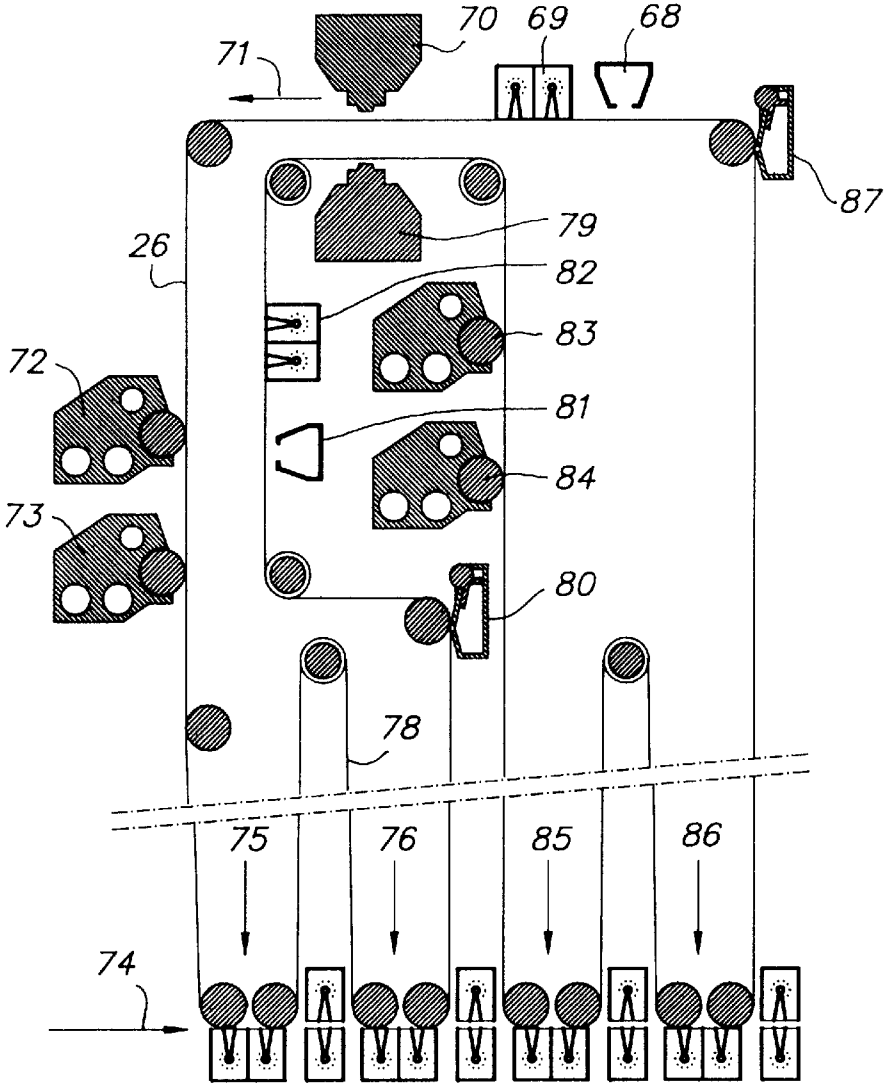
FIG. 5 is a diagrammatic view of an embodiment of an image forming station operating with two exposure stations.

An arrangement operating with two exposure stations and four developer units is shown in FIG. 5.

It comprises a first exposure station 70, in the present example a LED array, for image-wise exposing photoconductive belt 26, which has been properly erased by lamp unit 68 and charged by electrostatic charging unit 69, and which is driven by means, not shown, in the direction of arrow 71. The belt passes through two developer units 72 and 73, the first one being for instance, for developing a green part image and the second one a yellow station for developing a blue part image. Both units are switchable into and out of an operative state as described hereinbefore with reference to FIG. 1. Both developed toner images are transferred to a receptor sheet following a path through transfer stations 75 and 76, indicated by arrow 74. A loop 78 between both stations forms an image buffer as described hereinbefore.

A second exposure station 79 is provided for image-wise exposing the two other part images, such as the red and the black-and-white one. The photoconductive belt has previously been cleaned by cleaner 80, and erased and charged by stations 81 and 82, respectively. The red and black-and-white images exposed by station 79 are developed by corresponding developer units 83 and 84, and transferred to the receptor sheet in transfer stations 85 and 86.

The exposure stations 70 and 79, the developer units 72, 73, 83 and 84, and the transfer stations 75, 76, 85 and 86 are controlled in timed relationship so that, taking also into account the length of the image buffers on the belt between the different transfer stations, the four toner images are transferred onto each other in perfect coinciding superimposed relationship as the receptor sheet moves through the successive transfer stations.

Cleaner 87 cleans photoconductive belt 26 before it is erased and charged at 68 and 69.

The described arrangement can be followed by an identical one but located at the other side of the path of the receptor sheet, to operate in duplex. Then, the images on the receptor sheet can be fixed.

Figure 6:
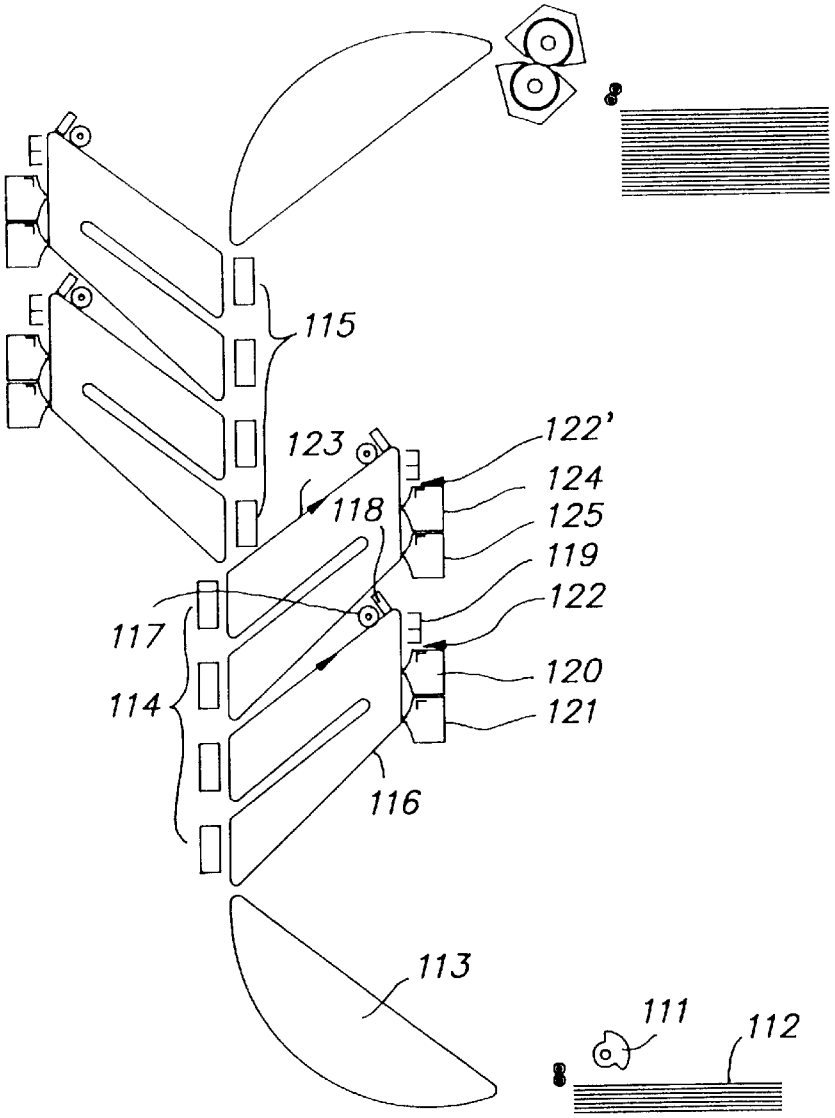
FIG. 6 is a diagrammatic view of an embodiment of a duplex printer operating with different recording belts and different exposure stations.

FIG. 6 diagramatically illustrates an embodiment of a duplex printer according to the invention which uses for each imaging device two photoconductive belts, and for each such belt two exposure units. Thus, a receptor sheet removed by finger 111 from stack 112 is conveyed upwardly by conveyer 113 along two series 114, 115 of four transfer stations. Referring to stations 114, a first photoconductive belt 116 running in loops as shown, is cleaned at 117, erased at 118 and electrostatically charged at 119 before being image-wise exposed at 122, e.g. by laser exposure. Units 120 and 121 are two developing stations. A second belt 123 is similarly exposed by unit 122 and developed by stations 124 and 125. The timing of operation of the exposure units is such that appropriate registering in superimposed relationship of the four toner images is obtained.

The same conditions apply to the upper half of the apparatus where transfer stations 115 transfer the part images of two photoconductive belts, image-wise exposed each by two exposure stations and next developed. The advantage of the vertical sheet transport in the described embodiment is a notable reduction in floor space of the machine. Another advantage is that gravity is working in the same way on both sides of the receptor sheet.

Figure 7:
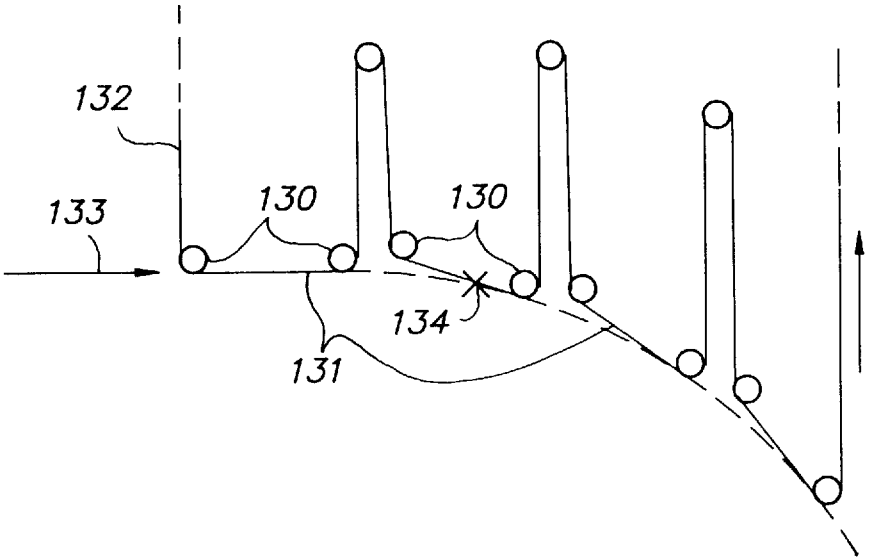
FIG. 7 is a diagrammatic view of a colour image transfer arrangement in which the receptor sheet follows a curved path.

FIG. 7 shows an embodiment of the invention wherein a receptor sheet follows a curved instead of a straight path through the image transfer zone. The illustration is diagrammatic only but it is clear that belt guide rollers 130 are disposed in such a way that they determine subpaths 131 for photoconductive belt 132 which, although individually straight, are mutually inclined. These subpaths determine for a sheet entering at the location of arrow 133 a path which has nearly the form of a polygon with rounded corners, the leading sheet edge entering each time in contact with a subsection of the belt approximately half its length, e.g. at a position approximately as indicated by cross 134. Incomplete contact of the receptor sheet with the toner image on the photoconductive belt in the first part of its stretch in a toner transfer area is not detrimental to image quality.

Figure 8:
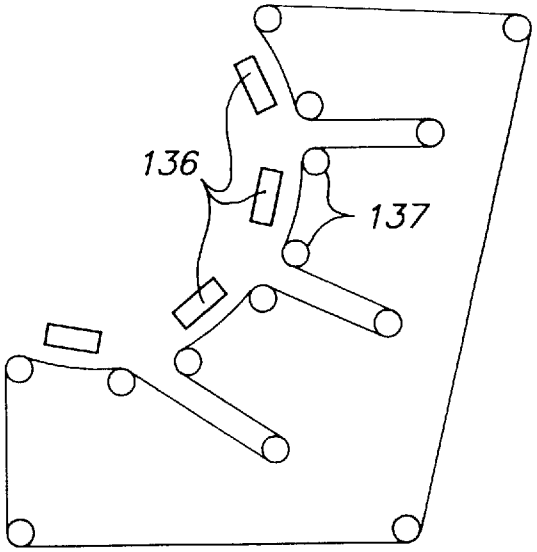
FIG. 8 is an arrangement in which a receptor sheet is made to follow a path concavely curved over 180 angular degrees.

FIG. 8 shows that the sheet path determined by transfer stations 136 need not necessarily be slightly curved concavely as in FIG. 7, but can span an arc of 180 angular degrees or even more, so that a compact design of the apparatus becomes possible. The respective stretches of the recording belt between the two guide rollers 137 of each transfer station can be concave as shown. This can be obtained by the use of vacuum boxes with concave top plate at the rear side of the belt.

Still further embodiments of the invention are as follows.

Sheets fed from stack 12 as in FIG. 1 can occasionally be subjected to a drying operation prior to the toner image transfer, in order to get a sufficiently low moisture content, e.g. below 60%. We have found that a high(er) moisture content is unfavourable for back transfer of toner to the photoconductor. Such paper conditioning means can be incorporated in alignment module 16.

The transfer stations can have electrostatic charging provisions that differ from those illustrated hereinbefore. We refer to our co-pending application No. 96/20 2251.3 mentioned already wherein different charging arrangements, that have a toner image transferring function as well as an electrostatic attraction function for the sheet by the photoconductive belt, have been described.

The reversal of a receptor sheet in a duplex printer which comprises one image forming station only, need not necessarily occur about a transverse axis but can occur along a longitudinal axis as well.

The transport of a receptor sheet from a first image forming station to a second one in order to operate in duplex, can also occur by sheet lifting means or a vacuum belt in the event of suchlike stations being located one on top of the other.

The fixing step has been described as occurring after the transfer of the two images in duplex printing. It is clear that one transferred image may be fixed before the second one becomes transferred.

The sheet supporting distance x, the diameter of the belt guiding rollers, the unsupported distance g, and the pitch p may be smaller than the values mentioned hereinbefore leading to an even better control of the sheet path and to a more compact machine. However, they may also be larger in the case of relatively stiff sheets and/or large printing widths requiring belt supporting rollers with a larger diameter to obtain sufficient stiffness.

We claim:

1. An electrostatographic colour printing apparatus comprising:

exposure means for forming successive electrostatic latent images on a surface of a recording member in the form of an endless belt, said belt comprising a plurality of image transferring sections;

developing stations for sequentially developing said electrostatic latent images to form toner images on said belt; and a transfer zone comprising electrostatic transfer stations for sequentially transferring said toner images from said belt in superposition onto a receptor sheet fed through said transfer stations while in contact with said image transferring sections therein to form a multicolour toner image, wherein transport of said receptor sheet through each of said transfer stations occurs by frictional contact of said receptor sheet with a corresponding one of said image transferring sections in said transfer stations under the influence of electrostatic attraction forces, in the absence of a moving backing belt, wherein said transfer stations are proximately mounted to each other, each of said transfer stations comprising directional means imparting a direction of motion to said belt such that said receptor sheet passing through said transfer stations is properly positioned with respect to said image transferring sections, and wherein at least two of said developing stations are mounted between said exposure means and said transfer zone.

2. The printing apparatus according to claim 1, wherein said receptor sheet follows a path in the transfer zone that is substantially rectilinear.

3. The printing apparatus according to claim 1, wherein said developing stations are arranged between said exposure means and said transfer stations.

4. The printing apparatus according to claim 3, further comprising:

a single exposure station for recording said electrostatic latent images on said belt;

a cleaning station for removing residual toner particles remaining on said belt after transfer of said toner images onto said receptor sheet; and an erasing station for removing residual charges remaining on said belt after transfer of said toner images onto said receptor sheet.

5. The printing apparatus according to claim 1, wherein said exposure means, developing stations and transfer zone are provided in duplicate for printing a duplex image.

6. The printing apparatus according to claim 1, wherein said directional means comprises two parallel belt guide rollers imparting a controlled linear path to said belt between said guide rollers, said linear path having a length x.

7. The printing apparatus according to claim 6, wherein the diameter of said guide rollers is less than 50 mm.

8. The printing apparatus according to claim 6, wherein the length x of said linear path is not greater than 120 mm.

9. The printing apparatus according to claim 1, wherein an unsupported distance of said receptor sheet between two successive transfer stations is not greater than the x length of a linear path over which said receptor sheet is in contact with a corresponding image transferring section of said belt.

10. The printing apparatus according to claim 9, wherein said unsupported distance is no greater than 70 mm.

11. The printing apparatus according to claim 1, comprising means for exerting pressure on a side of said receptor sheet remote from the belt to improve the reproducible pick-up of a leading edge of said receptor sheet by the belt.

12. The printing apparatus according to claim 11, wherein said pressure exerting means comprises air jet producing nozzles.

13. The printing apparatus according to claim 11, wherein said pressure exerting means comprises stationary guide members.

14. The printing apparatus according to claim 1, further comprising belt conveying means for conveying said belt in a folded path between said transfer stations to form a complete image buffer between adjacent transfer stations.

15. The printing apparatus according to claim 1, wherein said belt has a photoconductive recording surface.

* * * * *